US005785248A

United States Patent [19]

Staylor et al.

[11] Patent Number: 5,785,248

[45] Date of Patent: Jul. 28, 1998

[54] ROTARY SPRINKLER DRIVE ASSEMBLY WITH FILTER SCREEN

[75] Inventors: John L. Staylor; Jeff R. McKenzie; Rebecca R. Reade, all of Riverside, Calif.

[73] Assignee: The Toro Company, Minneapolis, Minn.

[21] Appl. No.: 605,712

[22] Filed: Feb. 22, 1996

[51] Int. Cl.[6] ..... B05B 3/04

[52] U.S. Cl. ..... 239/237; 239/240; 239/462; 239/DIG. 1

[58] Field of Search ..... 239/201–206, 239/230, 232, 237, 240, 462, 590, DIG. 1

[56] References Cited

U.S. PATENT DOCUMENTS

| | | | |
|---|---|---|---|
| 1,203,542 | 10/1916 | Hawley | 239/205 |
| 1,882,922 | 10/1932 | Robinson et al. | 239/204 |
| 3,105,639 | 10/1963 | Jepson | 239/242 |
| 3,131,867 | 5/1964 | Miller et al. | 239/206 |
| 3,258,205 | 6/1966 | Hruby, Jr. | 239/205 |
| 3,272,436 | 9/1966 | Hunter | 239/204 |
| 3,567,127 | 3/1971 | Raumaker | 239/237 |
| 3,580,506 | 5/1971 | Costa | 239/206 |
| 3,580,508 | 5/1971 | Marandi | 239/206 |
| 3,583,638 | 6/1971 | Eby | 239/206 |
| 4,002,295 | 1/1977 | Drori | 239/230 |
| 4,026,471 | 5/1977 | Hunter | 239/206 |
| 4,078,726 | 3/1978 | Walto | 239/590 |
| 4,637,548 | 1/1987 | Ray et al. | 239/201 |
| 4,773,595 | 9/1988 | Livne | 239/203 |
| 4,867,378 | 9/1989 | Kah, Jr | 239/206 |
| 4,892,252 | 1/1990 | Bruninga | 239/240 |
| 4,971,250 | 11/1990 | Hunter | 239/203 |
| 5,004,157 | 4/1991 | Martell | 239/205 |
| 5,083,709 | 1/1992 | Iwanowski | 239/551 |
| 5,174,501 | 12/1992 | Hader | 239/205 |
| 5,265,803 | 11/1993 | Thayer | 239/201 |
| 5,292,071 | 3/1994 | Kruer | 239/240 |
| 5,375,768 | 12/1994 | Clark | 239/205 |
| 5,423,486 | 6/1995 | Hunter | 239/205 |

FOREIGN PATENT DOCUMENTS

| | | | |
|---|---|---|---|
| 527814 | 6/1931 | Germany | 239/205 |

*Primary Examiner*—Andres Kashnikow
*Assistant Examiner*—Lisa Ann Douglas
*Attorney, Agent, or Firm*—James W. Miller

[57] ABSTRACT

A gear drive assembly for a rotary sprinkler includes a drive housing in which a reduction gear train is enclosed. A turbine located beneath one end of the drive housing rotates the gear train through a turbine shaft that extends into the drive housing. An output shaft extends out of the other end of the drive housing for rotating the nozzle assembly of the rotary sprinkler. The drive assembly includes a relatively large water entry port which is screened by a filter screen having relatively small openings. The water entry port allow enough water to enter the drive housing upon initial pressurization of the sprinkler such that sand particles suspended in the water do not jam the output shaft or the turbine shaft. The openings in the filter screen prevent the entry of particles into the drive housing that would tend to jam or foul the reduction gear train.

14 Claims, 5 Drawing Sheets

ROTARY SPRINKLER DRIVE ASSEMBLY WITH FILTER SCREEN

TECHNICAL FIELD

This invention relates to a rotary sprinkler having a reduction gear drive assembly for rotating a sprinkler nozzle. More particularly, this invention relates to an improved drive assembly having at least one water entry port covered by a filter screen for admitting water to the interior of the drive assembly.

BACKGROUND OF THE INVENTION

Rotary sprinklers are well known having a gear drive assembly powered by the force of the water passing through the sprinkler. The drive assembly typically includes a drive housing which encloses a reduction gear train. A water driven turbine located adjacent one end of the drive housing drives a turbine shaft that rotates the gear train within the drive housing. An output shaft at the other end of the drive housing is driven by the gear train and is attached to the nozzle assembly for rotating the nozzle assembly at a speed slower than the speed of rotation of the turbine.

In a drive assembly of this type, water can pass around the turbine and output shafts and enter the drive housing, particularly during the initial inrush of water when the sprinkler is turned on and pressurization of the sprinkler housing occurs. When the water contains particulate debris of small size such as fine sand, such debris can pass through the usual basket screen that is located upstream of the drive assembly. This debris is then able to lodge in the annular gaps around the turbine and/or output shafts. This locks up these shafts preventing their rotation and preventing the proper operation of the drive assembly. Accordingly, the drive assembly must be repaired or replaced, which is time-consuming, expensive and therefore a disadvantage of known drive assembly designs.

SUMMARY OF THE INVENTION

This invention relates to a drive assembly that solves the problem of having the drive assembly become jammed due to debris particles wedging against the output or turbine shafts.

This aspect of this invention is embodied in a gear drive assembly for a rotary sprinkler with the drive assembly being of the type that is powered by the force of water passing through the sprinkler. The drive assembly comprises a drive housing which encloses a reduction gear train. A water driven turbine is located adjacent one end of the drive housing. The turbine drives a turbine shaft that extends into the drive housing to rotate the reduction gear train within the drive housing. An output shaft at the other end of the drive housing is driven by the gear train. The output shaft extends out of the drive housing and is suited to be attached to a nozzle assembly of the rotary sprinkler for rotating the nozzle assembly at a speed slower than the speed of rotation of the turbine. A means is provided for creating a preferential water entry path into the drive housing which causes the substantial majority of the water that enters the drive housing during initial inrush and pressurization of the sprinkler to enter at spot(s) other than around the output shaft and the turbine shaft.

BRIEF DESCRIPTION OF THE DRAWINGS

This invention will be described more completely hereafter in the Detailed Description, when taken in conjunction with the following drawings, in which like reference numerals refer to like elements throughout.

DETAILED DESCRIPTION

Figure 1:
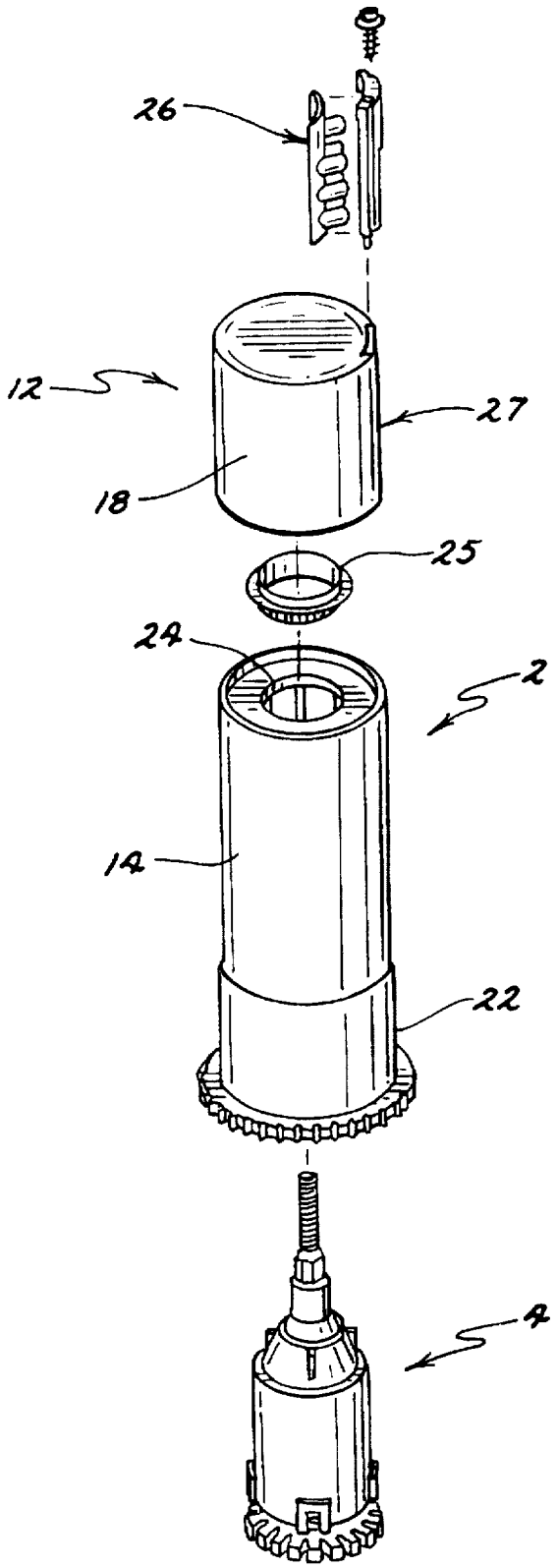
FIG. 1 is a perspective view of the relevant portion of a rotary sprinkler having the improved drive assembly of this invention, the parts being shown in an exploded form for the sake of clarity.

Referring first to FIG. 1, this invention relates to an improved drive assembly 4 for a rotary sprinkler illustrated generally as 2. Preferably, drive assembly 4 is powered solely by the force of the water flowing through sprinkler 2 so that no external source of power is required. Drive assembly 4 is preferably one which employs a reduction gear train 6 to rotate output shaft 8 of drive assembly 4 at a slower speed than turbine shaft 10. Thus, drive assembly 4 is able to rotate a nozzle assembly 12 about a rotational axis defined by the axis of output shaft 8 at a relatively slow speed suited to allow nozzle assembly 12 to deliver water to an area of ground that is traversed by nozzle assembly 12.

Referring further to FIG. 1, sprinkler 2 includes a sprinkler housing 14 that forms a water flow passageway in which drive assembly 4 is concentrically positioned. A rotary nozzle assembly 12 of any conventional design is non-rotatably attached in any convenient manner to output shaft 8 of drive assembly 4. For example, output shaft 8 of drive assembly 4 has a hex shaped portion 16 that is non-rotatably received in a hex-shaped bore or passageway (not shown) provided in the lower end of nozzle body 18. The upper end of output shaft 8 is threaded as shown at 20 to receive a coupling nut (not shown) that can be tightened within nozzle body 18 to attach nozzle body 18 to output shaft 8. Thus, when drive assembly 4 is in operation, rotation of output shaft 8 rotates nozzle assembly 12 relative to the stationary sprinkler housing 14.

Sprinkler housing 14 includes an inlet end 22 through which pressurized water will flow. This water will travel through sprinkler housing 14 around the exterior of drive assembly 4 through suitable gaps or passages that remain between drive assembly 4 and the inner diameter of sprinkler housing 14. Drive assembly 4 is intentionally sized to have a diameter that is less than that of the inner diameter of sprinkler housing 14 to allow water to flow around drive assembly 4 with drive assembly 4 being normally non-rotatably held in sprinkler housing 14 by spider-like ribs that protrude inwardly from sprinkler housing 14 to engage against the exterior of drive assembly 4. The water will then exit through an outlet 24 in sprinkler housing 14 to flow up into nozzle body 18 with a seal 25 being located at the interface between nozzle body 18 and sprinkler housing 14 to prevent water leakage from the base of nozzle body 18.

The water entering nozzle body 18 is sprayed from nozzle body 18 through at least one discharge nozzle, indicated generally at 26, set in a recess 27 therefor provided in the peripheral sidewall of nozzle body 18. The adjustable sprinkler nozzle shown in the assignee's U.S. Pat. No. 5,526,982, is one such nozzle that could be used in nozzle body 18, which application is hereby incorporated by reference. However, the type of nozzle 26 used in nozzle body 18 is not important to this invention and can comprise any conventional sprinkler nozzle used for spraying a stream of water.

Sprinkler housing 14 as illustrated herein forms only a portion of a complete sprinkler, namely sprinkler housing 14 comprises the pop-up riser portion of a pop-up sprinkler. Thus, sprinkler housing 14 would normally be contained inside an outer sprinkler body (not shown). A spring (also not shown) retracts sprinkler housing 14 into the outer body when water is not flowing through sprinkler 2. However, when water is admitted to the outer body of sprinkler 2, this water pushes up on sprinkler housing 14 against the bias of the spring to cause sprinkler housing 14 to pop up out of the outer body until nozzle assembly 12 is located above the ground. Operation of drive assembly 4 under the force of the water flowing through sprinkler housing 14 will then rotate nozzle assembly 12 about a generally vertical rotational axis defined by the vertical orientation of output shaft 8. When water is shut off to sprinkler 2, the spring force will cause sprinkler housing 14 to retract back down into the outer body.

While drive assembly 4 is shown in a sprinkler housing 14 that comprises the pop-up riser portion of a pop-up sprinkler, drive assembly 4 is suited for use in non pop-up sprinklers as well. In this event, sprinkler housing 14 would simply form a stationary tube or standpipe that has its upper end, and hence nozzle assembly 12, located permanently above the ground. In this type of sprinkler 2, the inlet end 22 of sprinkler housing 14 would be formed to be connected directly to a pipe fitting for receiving water from an irrigation supply pipe. Thus, drive assembly 4 of this invention is useful in rotary sprinklers generally, regardless of their type, regardless of the specific shape, number or type of discharge nozzles 26 used in nozzle body 18, regardless of how nozzle body 18 is attached to output shaft 8 of drive assembly 4, etc. The improved drive assembly 4 of this invention is simply one which is fitted inside a water flow passageway and which is powered by the force of the water flowing through the water flow passageway to rotate a rotary sprinkler nozzle.

Typically, the water flow passageway formed by sprinkler housing 14 and in which drive assembly 4 is received is not continuously under pressure. Control valves (not shown) upstream of sprinkler 2 usually control the application of water under pressure to sprinkler 2 to turn sprinkler 2 on and off. When sprinkler 2 is off with the control valve closed, the pressure inside sprinkler housing 14 is at or close to atmospheric pressure. However, when sprinkler 2 is turned on by opening the control valve, water under pressure that is higher than atmospheric, and which is often one or more orders of magnitude higher, rushes into sprinkler housing 14 and pressurizes housing 14. One aspect of this invention is how drive assembly 4 reacts to and accommodates this initial inrush and pressurization of sprinkler housing 14.

Figure 2:
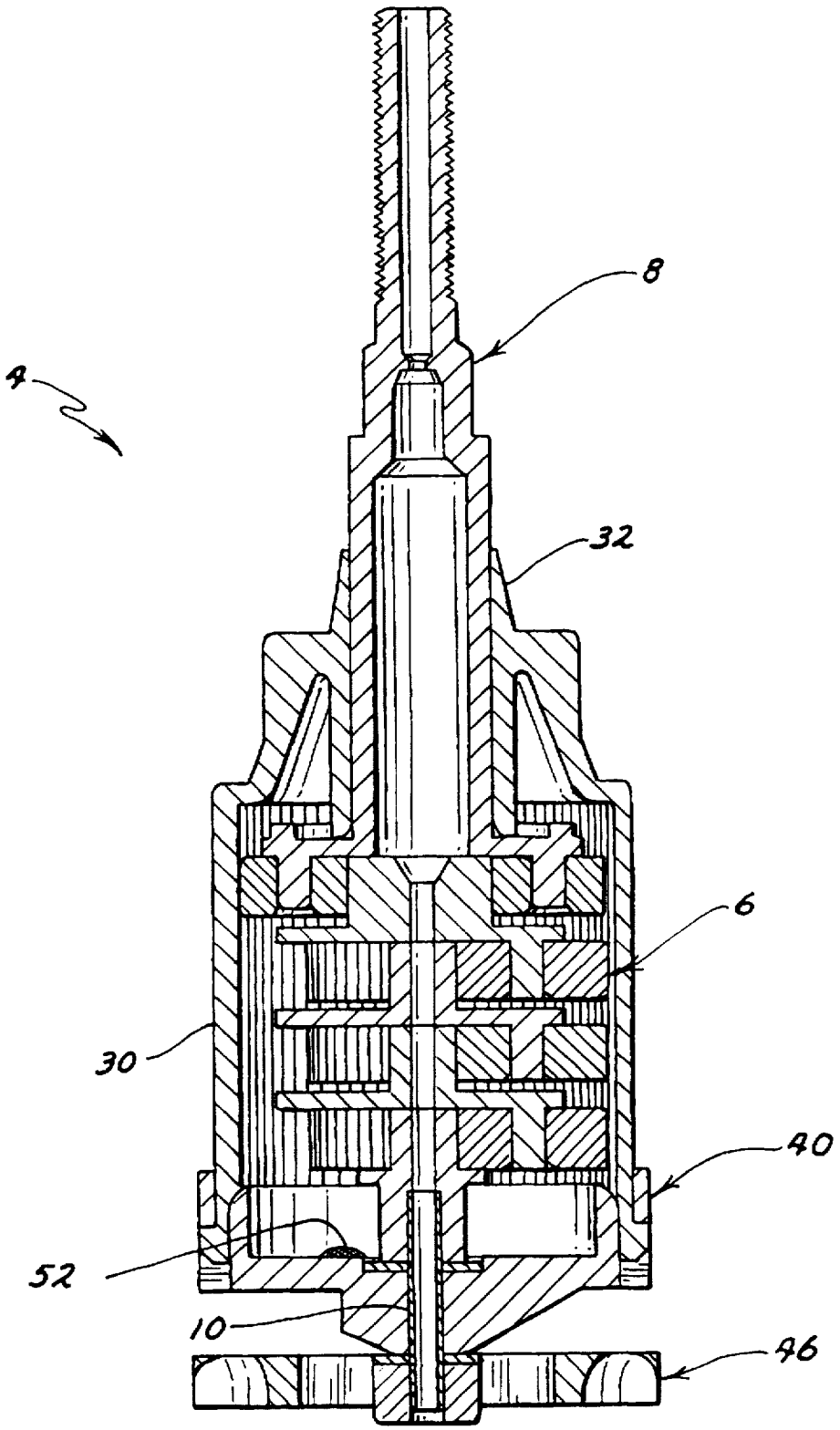
FIG. 2 is a cross-sectional view of the improved drive assembly of this invention.
Figure 3:
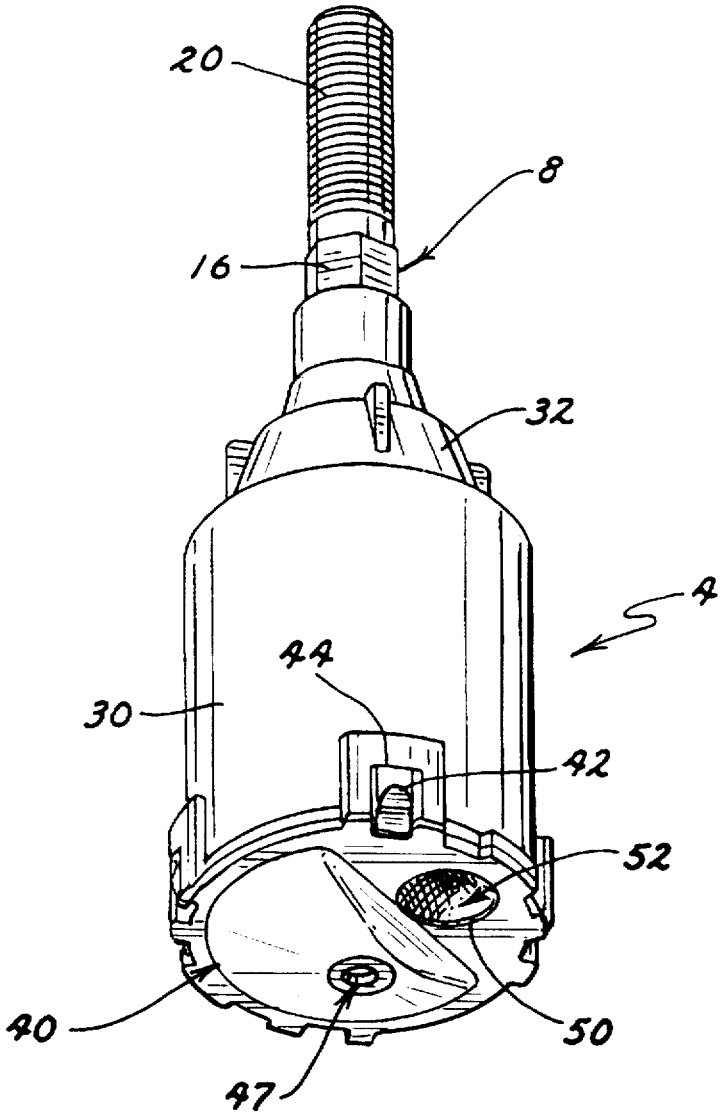
FIG. 3 is a perspective view of the improved drive assembly shown in FIG. 2, with the turbine removed to better illustrate the water entry port and filter screen placed in the end cap of the drive assembly to allow water to enter the interior of the drive assembly.
Figure 4:
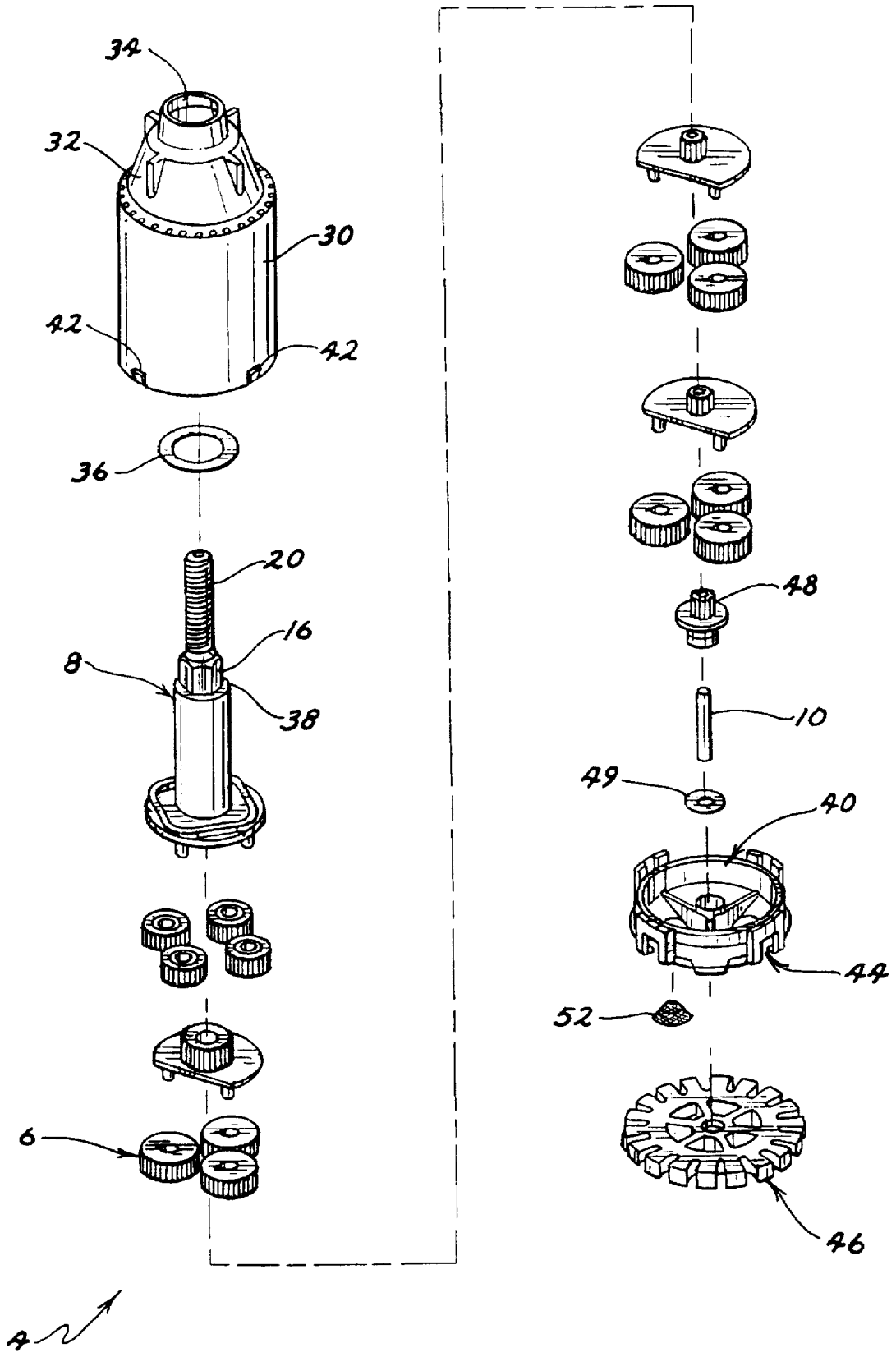
FIG. 4 is a perspective view of the drive assembly shown in FIG. 2, the parts being shown in an exploded form for the sake of clarity.

Referring now to FIGS. 2–4, drive assembly 4 includes a drive housing 30 that is generally, but not completely, enclosed. Drive housing 30 includes an upper, generally conically shaped end 32 having an opening 34 through which output shaft 8 of drive assembly 4 extends. A compression washer 36 can be compressed between a shoulder 38 on the output shaft and the inside of the upper end 32 of drive housing 30 to attempt to seal output shaft 8 against the passage of water around output shaft 8. However, this seal 36 is not completely effective in sealing output shaft 8, and so some water can find its way around output shaft 8 and into drive housing 30.

The lower end of drive housing 30 is open during assembly to allow reduction gear train 6 to be assembled in drive housing 30. Once the gear train assembly is completed, the lower end of drive housing 30 is closed by a generally cup-shaped end cap 40 that is affixed to drive housing 30 in any suitable manner. For example, the end cap/drive housing combination could be provided with interlocking tab 42 and slot 44 connectors that rigidly unite when end cap 40 is pressed onto the open end of drive housing 30. Alternatively, other means for affixing end cap 40 to drive housing 30, e.g. sonic welding, could be used.

A turbine 46 is located immediately beneath the lower end of drive housing 30, namely beneath end cap 40 after end cap 40 is affixed to the lower end of drive housing 30. Turbine shaft 10 extends upwardly through an opening or aperture 47 located in end cap 40 with turbine shaft 10 carrying a small diameter input gear 48 that drives reduction gear train 6 in drive housing 30. Thus, as turbine 46 spins under the influence of water passing through sprinkler housing 14 and past drive assembly 4, the rotation of turbine 46 will rotate shaft 10 and hence reduction gear train 6 to eventually rotate output shaft 8 at a slower rate of speed than turbine 46. Because output shaft 8 is affixed to nozzle assembly 12, nozzle assembly 12 is then rotated relatively slowly as determined by the amount of the reduction provided by reduction gear train 6.

A small compression seal 49 is used around turbine shaft 10, but this seal 49 does not tightly grip turbine shaft 10 because that would impose an undesirable drag on the turbine shaft. Instead, an annular gap exists between turbine shaft 10 and the inner diameter of opening 47 and the opening in compression seal 49.

In a drive assembly 4 of the type described herein, the Applicants have discovered that water tends to enter drive assembly 4 through various leakage points during the initial inrush and pressurization of sprinkler housing 14. This leakage occurs until the pressure inside drive housing 30 becomes approximately equal to the water pressure inside sprinkler housing 14. Such leakage occurs at any available openings, but primarily around turbine shaft 10 and to a lesser degree around output shaft 8. While the annular gaps around the outer diameters of output shaft 8 and turbine shaft 10 are quite small being on the order of 0.003 to 0.005 inches in width, they are large enough to permit water to enter and substantially fill the inside of drive assembly 4.

Thus, drive assembly 4 is a water lubricated drive. No grease or oil is enclosed within drive housing 30 around reduction gear train 6. Thus, drive assembly 4 is simpler and easier to manufacture. Moreover, drive assembly 4 is environmentally friendly as there is no grease and oil that can leak out of drive assembly 4 to contaminate the water flowing through sprinkler 2.

In certain sandy water conditions having fine sand or other similar debris particles suspended in the water supply, such as water commonly found in certain areas of the United States such as Florida, the Applicants have found that the particles suspended in the water often tend to lodge or jam in the annular gap between turbine shaft 10 and the opening 47 in which turbine shaft 10 rotates. Such debris will cause turbine shaft 10 to lock up and stop rotating. Such debris can also enter around output shaft 8 and lock it up as well, though this happens less-frequently. Obviously, such shaft lock up is a failure of drive assembly 4 which demands remedial action, i.e. either disassembly and cleaning of drive assembly 4 or even replacement of drive assembly 4. Such remedial action is costly and thus something which is desirably avoided.

The improvement of this invention comprises means for creating a preferential water entry path into drive assembly 4 which causes the substantial majority of the water that enters drive assembly 4 during initial inrush and pressurization to enter at non-critical spots, namely at spots other than the annular gaps around output shaft 8 and turbine shaft 10. Accordingly, at least one water entry port 50 is provided in drive assembly 4, preferably as a single circular port 50 in end cap 40 of drive assembly 4. A non-planar filter screen 52 is located in water entry port 50 to filter the water passing into drive housing 30 through water entry port 50.

Filter screen 52 is provided with openings 54 each about 0.006 inches in size, i.e. circular filter openings 54 having a diameter of about 0.006 inches or square filter openings 54 having a length along each side of about 0.006 inches. The size of filter openings 54 in filter screen 52 is selected to exclude from the interior of drive assembly 4 any particle or debris sizes that might be big enough to foul the gears or wedge in any of the clearances used in reduction gear train 6. Thus, for the size of the gears used in at least one drive assembly 4 built by the Applicants, 0.006 inches has been found to be a good value to use as the smallest critical clearance in reduction gear train 6 susceptible to jamming is on the order of 0.009 inches. Obviously, if a gear train with bigger gears or larger clearances were used, then the size of the openings in filter screen 52 could be increased as long as they remain slightly smaller than the smallest critical dimension of gear train 6.

The purpose of filter screen 52 is to exclude debris of a size that might jam or foul reduction gear train 6, but to otherwise allow water to enter port 50 and fill drive assembly 4 during the initial inrush and pressurization thereof. Obviously, sand or other debris smaller than filter openings 54 in filter screen 52 will be allowed to enter drive assembly 4, but such very small sized debris has no harmful effect upon the operation of gear train 6 or drive assembly 4. At the conclusion of the sprinkling operation, at least some of the water that has filled drive assembly 4 will drain back out of drive assembly 4 through filter screen 52 and water entry port 50.

Regardless of the size of filter openings 54 provided in filter screen 52, water entry port 50/filter screen 52 combination is sized to provide a preferential water entry path into drive assembly 4 having a predetermined area. This predetermined area comprises the cumulative open area of filter screen 52, namely the aggregate total area covered by all of filter openings 54 provided in filter screen 52. This total open area of the water entry path is preferably many times larger than the areas of the annular gap around either turbine shaft 10 or output shaft 8. Thus, during the initial water inrush and pressurization of sprinkler housing 14 when sprinkler 2 is turned on, the substantial majority of water will enter drive assembly 4 through the preferential water entry path formed by water entry port 50 and not try to get in around turbine shaft 10 or output shaft 8.

In one version of drive assembly 4 built by the Applicants, the area of the water entry path through water entry port 50/filter screen 52 is preferably at least 40 times larger, and preferably in the range of from 40 to 60 times larger, than the area of the annular gap around turbine shaft 10.

There is no critical formula for how large the area of the preferential water entry path should be. Obviously, the bigger it is in relation to the annular gaps or areas around turbine shaft 10 and output shaft 8, the more water will enter through that path and not around the shafts. The area of the preferential water entry path should be big enough so that drive assembly 4 will pass one or more debris tests. Two such tests have been used by the Applicants as a benchmark for drive assembly 4.

In one test used by the Applicants and referred to as the sand influx test, a total quantity of sand selected as follows:

| Sprinkler Water Inlet Size | Quantity of Sand [In cubic inches or milliliters (mls)] | |
|---|---|---|
| ½" | 1 cubic inch | (16 ± 2 mls) |
| ¾" | 2 cubic inches | (32 ± 2 mls) |
| 1" | 2 cubic inches | (32 ± 2 mls) |
| 1-½" | 6 cubic inches | (96 ± 3 mls) |

is placed into the supply pipe leading to sprinkler 2 upstream of sprinkler 2, with the total quantity of sand being composed of equal quantities of #60, #90 and #120 silica sand. Sprinkler 2 is then turned on, run for approximately fifteen seconds or so, and then turned off. This is done for five separate cycles with the sand being added only once before the first cycle. The goal is to have drive assembly 4 operate properly through all 5 cycles of operation without becoming jammed by the sand.

With respect to this sand influx test, the Applicants have found that a drive assembly 4 built without water entry port 50/filter screen 52 combination will not pass the 5 cycle limitation, i.e. drive assembly 4 will jam at some point before the completion of the 5 cycles. However, with a water entry port 50 and filter screen 52 as shown herein, sprinkler 2 will satisfactorily operate through all 5 cycles without jamming. Accordingly, the open area provided by the water entry path and filter screen combination should be sufficient to allow sprinkler 2 to pass the sand influx test just described.

Another test used by the Applicants, known as the life internal debris test, is to run sprinkler 2 substantially continuously for 200 hours in a recirculating water solution in which sand is suspended. In this test, sprinkler 2 is run for 28 minutes, turned off for 2 minutes, turned back on for 28 minutes, off for 2 minutes, and so on, until 200 hours have elapsed. 20±1 milliliters of silica sand containing approximately equal quantities of #60 and #90 silica sand is suspended in approximately 80 gallons of water such that the sand concentration in parts per million is 100±5 parts of sand per million parts of water. Again, Applicants have found that drive assemblies 4 not having water entry port 50/filter screen 52 combination do not pass this test. But, they do pass the test when a water entry port 50/filter screen 52 as disclosed herein is incorporated into drive assembly 4.

Accordingly, drive assembly 4 should be built such that the preferential water entry path into drive assembly 4, i.e. water entry ports other than for those around turbine shaft 10 or output shaft 8, have a combined area which is sufficiently large to pass either, and preferably both, of these two tests.

Figure 5:
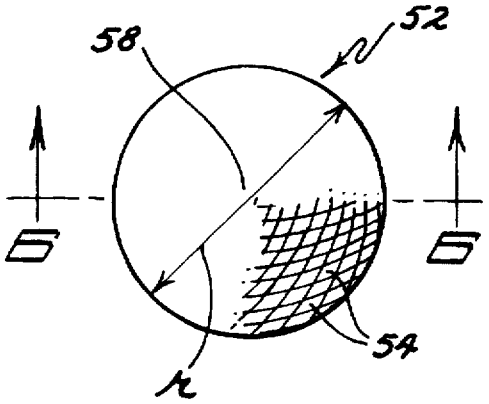
FIG. 5 is a top plan view of a first embodiment of filter screen that may be used in the drive assembly of FIG. 2.
Figure 6:
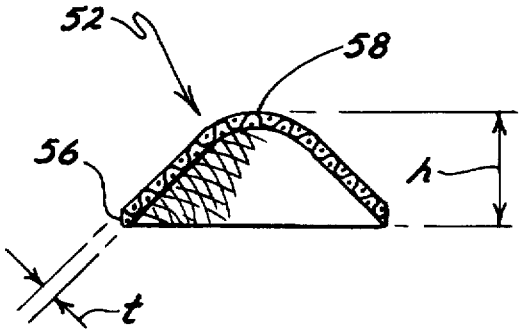
FIG. 6 is a cross-sectional view of the first filter screen shown in FIG. 4, taken along lines 6—6 of FIG. 5.

The Applicants have used two different filter screens 52 in combination with water entry port 50, both having a non-planar configuration. Referring now to FIGS. 5 and 6, the first filter screen 52 is conically shaped and made of 304 sintered stainless steel having a thickness of 0.015 inches with a 40×200 Dutch Weave. Filter screen 52 is installed such that the larger diameter end 56 of filter screen 52, having a radius r of approximately 0.300 inches, is installed in water entry port 50. The conically shaped body of filter screen 52, which has a height of approximately 0.125 inches, leading to the smaller diameter end 58 of filter screen 52 sticks up from end cap 40 into drive assembly 4. Filter screen 52 desirably extends up into drive assembly 4 rather than hanging down beneath drive assembly 4. See FIG. 3.

This configuration of filter screen 52 is desirable since it effectively enlarges the size of the water entry path from that provided if filter screen 52 were simply a flat screen installed in water entry port 50. In the flat screen scenario, the combined areas of filter openings 54 in filter screen 52 would inherently be less than the area of port 50 itself due to the lattice structure of filter screen 52, i.e. the longitudinal and transverse weaves of the screen, which take up some area. However, by making filter screen 52 in a non-planar configuration and extending it up into drive assembly 4, the effective open area is the open area in all of the sides of filter screen 52 such that the effective open area can approximate the open area of water entry port 50 itself. Thus, when using a single water entry port 50 and a single filter screen 52, it is preferred that filter screen 52 have a non-planar configuration as indicated by the conical, stainless steel filter screen 52 shown in FIGS. 5 and 6.

An alternative to using a single water entry port 50 and a single, non-planar filter screen 52 is to use multiple circular entry ports 50 on end cap 40 with multiple flat filter screens 52 placed therein. For example, the Applicants built a drive assembly 4 with two circular water entry ports 50 on either side of turbine shaft 10, each screened by a flat, sintered, stainless steel filter screen 52. Such a drive assembly also worked adequately well and passed the sand influx and life internal debris tests noted above because the combined flow through both ports 50 was sufficiently high to draw most of the water away from the gaps around output shaft 8 and turbine shaft 10. However, the use of a single water entry port 50 with a single filter screen 52 is preferred due to assembly simplicity as only one filter screen 52 has to be installed in one opening 50.

Filter screen 52 may be installed in water entry port 50 in any convenient manner. Preferably, filter screen 52 is simply press fit into water entry port 50 in a tight manner, with the entry port 50 being slightly smaller than the outer diameter of filter screen 52 at its largest end 56. Thus, filter screen 52 becomes crimped or set in the plastic material of end cap 40 as it is pressed up into water entry port 50. In addition, the flow of the water into drive assembly 4 each time sprinkler 2 is turned on further tends to press filter screen 52 into drive assembly 4 and does not tend to dislodge it. Thus, a tight press fit of filter screen 52 into water entry port 50 of drive assembly 4 is sufficient to hold it in place during operation of drive assembly 4. However, other attachment methods besides a press fit could be used to retain filter screen 52 in water entry port 50.

While filter screen 52 shown in FIGS. 5 and 6 works well in terms of allowing enough water to enter drive assembly 4 at points other than around turbine shaft 10 and output shaft 8, and screens the water well enough so that no debris enters drive assembly 4 that might jam or foul reduction gear train 6, the particular shape and material of filter screen 52 makes it difficult for an automated assembly machine to properly handle such filter screens. The largest end 56 of filter screen 52 terminates in a relatively rough edge given the nature of the stainless steel material of which it is made. This causes filter screens 52 to tend to tangle with other filter screens 52 in the feeder track of the automated machine. This in turn causes the parts to either stack up in the feeder track thereby stopping movement of filter screens 52 in the feeder track, or does not allow filter screens 52 to properly separate at the end of the feeder track, thus causing filter screens 52 not to be properly assembled or pressed into end cap 40.

Figure 7:
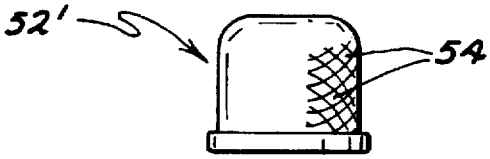
FIG. 7 is a side elevational view of a second embodiment of filter screen that may be used in the drive assembly of FIG. 2.
Figure 8:
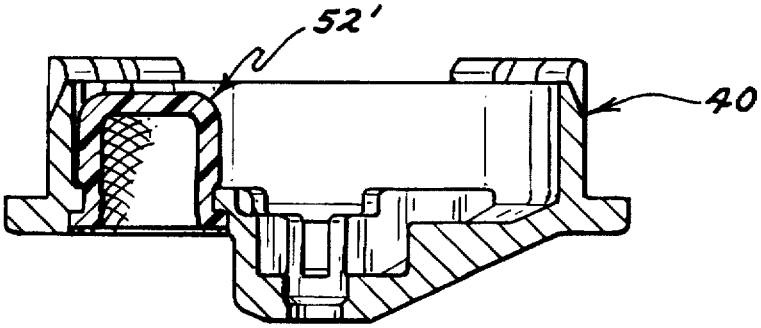
FIG. 8 is a cross-sectional view through the end cap of the drive assembly of FIG. 2, showing the second filter screen of FIG. 7 installed in the end cap and thus showing the cross-sectional shape of the second filter screen.

The alternative filter screen 52' shown in FIGS. 7 and 8 is believed to avoid these problems. Specifically, filter screen 52' desirably retains a non-planar configuration, this time being rectangularly shaped in the manner of a thimble instead of being conically shaped. In addition, it is molded from a porous, polyethylene or polypropylene material which looks like a plurality of spherical beads secured together in a matrix, the filter openings 54' in the material being the open areas between the beads. This filter screen 52' will be both easier to handle by the automated equipment as well as being significantly less expensive. The total savings in using this molded plastic filter screen 52', instead of using the stainless steel filter screen 52, will be on the order of $.08 per sprinkler.

Only a portion of each screen 52 or 52' is shown in the drawings as being in the form of a screen with filter openings 54 or 54' being provided in the lattice form of the screen. This is for the sake of clarity. Actually, the entire peripheral surface of each screen 52 or 52' is provided with this lattice form.

Various modifications of this invention will be apparent to those skilled in the art. For example, drive assembly 4 has been shown as one in which the water passing through sprinkler housing 14 desirably flows around the outside of drive assembly 4 after drive assembly 4 becomes pressurized and fills with water. However, drive assembly 4 could be built so that water passes through the drive assembly on its way to nozzle assembly 12, in which case reduction gear train 6 would be enclosed in a chamber located only on one side of drive assembly 4. Water entry port 50 and filter screen 52 or 52' would still be used in conjunction with such a drive assembly leading into the chamber in which the reduction gear train 6 is enclosed. Similarly, water entry port 50 and filter screen 52 or 52' could be located on surfaces of drive assembly 4 other than end cap 40, such as being located on the top end 32 of drive assembly 4. Accordingly, this invention is to be limited only by the appended claims.

We claim:

1. A gear drive assembly for a rotary sprinkler with the drive assembly being of the type that is powered by the force of water passing through the sprinkler, which comprises:

(a) a drive housing which is configured to be substantially entirely lubricated by water entering the drive housing and which encloses a reduction gear train;

(b) a water driven turbine located adjacent one end of the drive housing, wherein the turbine drives a turbine shaft that extends into the drive housing to rotate the reduction gear train within the drive housing;

(c) an output shaft at the other end of the drive housing driven by the gear train, wherein the output shaft extends out of the drive housing and is suited to be attached to a nozzle assembly of the rotary sprinkler for rotating the nozzle assembly at a speed slower than the speed of rotation of the turbine; and (d) means for creating a preferential water entry path into the drive housing which causes the substantial majority of the water that enters the drive housing during initial inrush and pressurization of the sprinkler to enter at spot(s) other than around the output shaft and the turbine shaft.

2. A drive assembly as set forth in claim 1, wherein the preferential water entry path creating means comprises at least one water entry port provided in an exterior wall of the drive housing, and further including means placed in the water entry port for filtering water passing therethrough into the drive housing.

3. A drive assembly as set forth in claim 2, wherein the area of the water entry port is at least 40 times larger than the area of any annular gaps existing around the turbine shaft.

4. A drive assembly as set forth in claim 2, wherein the filtering means comprises a filter screen having openings that are sized to exclude from the drive housing debris particles that would jam or foul the reduction gear train.

5. A drive assembly as set forth in claim 4, wherein the filter screen has a non-planar configuration.

6. A drive assembly as set forth in claim 2, wherein the filtering means comprises a filter screen having a non-planar configuration.

7. A drive assembly as set forth in claim 6, wherein the filter screen has a conical configuration that extends up into the drive housing.

8. A drive assembly as set forth in claim 7, wherein the filter screen is made of a stainless steel material.

9. A drive assembly as set forth in claim 6, wherein the filter screen has a rectangular, thimble like shape.

10. A drive assembly as set forth in claim 9, wherein the filter screen is made from a porous plastic material.

11. A gear drive assembly for a rotary sprinkler with the drive assembly being of the type that is powered by the force of water passing through the sprinkler, which comprises:

(a) a drive housing which encloses a reduction gear train;

(b) a water driven turbine located adjacent one end of the drive housing, wherein the turbine drives a turbine shaft that extends into the drive housing to rotate the reduction gear train within the drive housing;

(c) an output shaft at the other end of the drive housing driven by the gear train, wherein the output shaft extends out of the drive housing and is suited to be attached to a nozzle assembly of the rotary sprinkler for rotating the nozzle assembly at a speed slower than the speed of rotation of the turbine; and (d) means for creating a preferential water entry path into the drive housing which causes enough water to enter the drive housing during initial inrush and pressurization of the sprinkler at spot(s) other than around the output shaft and the turbine shaft such that the drive assembly is able to pass at least one of the following tests:

(i) a sand influx test in which a total quantity of sand selected as follows:

| Sprinkler Water Inlet Size | Quantity of Sand (In cubic inches) |
|---|---|
| ½" | 1 cubic inch |
| ¾" | 2 cubic inches |
| 1" | 2 cubic inches |
| 1-½" | 6 cubic inches |

is placed into the sprinkler inlet with the total quantity of sand being composed of equal quantities of #60, #90 and #120 silica sand, the sprinkler is then operated for approximately fifteen seconds for five separate cycles with the sand being added only once before the first cycle, and the drive assembly operates properly through all five cycles without becoming jammed by the sand; or (ii) a life internal debris test in which the sprinkler properly operates substantially continuously for 200 hours in a water solution in which equal quantities of #60 and #90 silica sand are suspended such that the overall sand concentration in parts per million is 100±5 parts of sand per million parts of water.

12. A drive assembly as set forth in claim 11, in which the preferential water entry path creating means causes enough water to enter the drive housing during initial inrush and pressurization of the sprinkler at spot(s) other than around the output shaft and the turbine shaft such that the drive assembly is able to pass both the and influx and the life internal debris test.

13. A gear drive assembly for a rotary sprinkler with the drive assembly being of the type that is powered by the force of water passing through the sprinkler, which comprises:

(a) a drive housing which is configured to be substantially entirely lubricated by water entering the drive housing and which encloses a reduction gear train;

(b) a water driven turbine located adjacent one end of the drive housing, wherein the turbine drives a turbine shaft that extends into the drive housing to rotate the reduction gear train within the drive housing;

(c) an output shaft at the other end of the drive housing driven by the gear train, wherein the output shaft extends out of the drive housing and is suited to be attached to a nozzle assembly of the rotary sprinkler for rotating the nozzle assembly at a speed slower than the speed of rotation of the turbine; and (d) at least one substantially straight, non-tortuous water entry port provided in an exterior wall of the drive housing to allow water to enter the drive housing through at least one location other than around the turbine and output shafts, and a filter screen located in the entry port for filtering the water passing through the entry port.

14. A drive assembly as set forth in claim 13, wherein the filter screen has a non-planar configuration.

* * * * *